US007458540B2

(12) United States Patent
Weber et al.

(10) Patent No.: US 7,458,540 B2
(45) Date of Patent: Dec. 2, 2008

(54) SYSTEM AND PROCESS FOR CONTROLLING THE DECELERATION AND ACCELERATION RATES OF A SHEET MATERIAL IN FORMING ABSORBENT ARTICLES

(75) Inventors: Paul A. Weber, Appleton, WI (US); David Fugate, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 581 days.

(21) Appl. No.: 10/720,979

(22) Filed: Nov. 24, 2003

(65) Prior Publication Data

US 2005/0139713 A1 Jun. 30, 2005

(51) Int. Cl.
*B65H 19/14* (2006.01)

(52) U.S. Cl. ..... 242/552; 242/417.2; 242/419.9

(58) Field of Classification Search ..... 242/552, 242/417.2, 417.3, 419.9, 554, 104, 105; 226/104, 105
See application file for complete search history.

(56) References Cited

U.S. PATENT DOCUMENTS 3,822,838 A * 7/1974 Butler et al. ..... 242/417.2
3,836,089 A * 9/1974 Riemersma ..... 242/417.3
4,100,012 A 7/1978 Meihofer et al.
4,157,934 A 6/1979 Ryan et al.
4,233,104 A 11/1980 Fujishima et al.
4,281,803 A 8/1981 Massey
4,450,039 A 5/1984 Salvucci et al.
4,526,638 A 7/1985 Clements
4,645,109 A 2/1987 Fleissner
4,915,282 A 4/1990 Martin et al.
4,923,546 A 5/1990 Wheeler et al.
4,948,060 A 8/1990 Kurz et al.
5,163,594 A * 11/1992 Meyer ..... 226/118.2
5,190,234 A 3/1993 Ezekiel
5,223,069 A 6/1993 Tokuno et al.

(Continued)

FOREIGN PATENT DOCUMENTS

WO WO 03033384 A1 4/2003

OTHER PUBLICATIONS

Abstract of Japanese Patent No. 08325645, Dec. 10, 1996.

(Continued)

*Primary Examiner*—Sang Kim
(74) *Attorney, Agent, or Firm*—Dority & Manning, P.A.

(57) ABSTRACT

A system and process for unwinding materials in forming absorbent articles is described. The system includes an unwind device in association with a festoon. The festoon is for accumulating a determined length of material. The amount of material contained in the festoon is increased or decreased depending upon the rate at which a roll of material is unwound in relation to the rate at which the first material is fed into a downstream process. In order to minimize the capacity of the festoon and in order to minimize tension swings in the festoon, the festoon includes a plurality of drive devices associated with selected guide rolls contained in the festoon. The drive devices can accelerate and/or decelerate the guide rolls in response to rate increases or decreases occurring at the unwind device in relation to the downstream process speed. In one embodiment, each of the guide rolls is controlled independently of the remaining guide rolls in the festoon.

34 Claims, 9 Drawing Sheets

U.S. PATENT DOCUMENTS

| | | | |
|---|---|---|---|
| 5,320,266 | A | 6/1994 | Noé et al. |
| 5,357,178 | A | 10/1994 | Kapitan |
| 5,514,237 | A | 5/1996 | Emenaker et al. |
| 5,573,626 | A | 11/1996 | Rossini et al. |
| 5,599,417 | A | 2/1997 | Glaug et al. |
| 5,659,229 | A | 8/1997 | Rajala |
| 5,660,666 | A | 8/1997 | Dilnik et al. |
| 5,671,895 | A | 9/1997 | Cederholm et al. |
| 5,679,195 | A | 10/1997 | O'Dwyer et al. |
| 5,692,698 | A | 12/1997 | Forbes |
| 5,904,672 | A | 5/1999 | LeMahieu et al. |
| 6,036,805 | A | 3/2000 | McNichols |
| 6,329,565 | B1 | 12/2001 | Dutkiewicz et al. |
| 6,473,669 | B2 | 10/2002 | Rajala et al. |
| 6,533,213 | B2 | 3/2003 | Durrance et al. |
| 6,552,245 | B1 | 4/2003 | Roessler et al. |
| 6,562,167 | B2 | 5/2003 | Coenen et al. |

OTHER PUBLICATIONS

PCT Search Report and Written Opinion for PCT/US2004/010160, Oct. 7, 2004.
U.S. Appl. No. 60/495,209 entitled "Improved Magnetic Roller".

* cited by examiner

SYSTEM AND PROCESS FOR CONTROLLING THE DECELERATION AND ACCELERATION RATES OF A SHEET MATERIAL IN FORMING ABSORBENT ARTICLES

BACKGROUND OF THE INVENTION

The manufacture of products such as disposable absorbent articles involves the use of flexible materials. The flexible materials can include, by way of illustration, non-woven materials, elastic materials, adhesive tapes, polymeric films, release paper, mechanical fastening materials, paper webs, and the like. During the formation of products, these materials are typically unwound from relatively large rolls of material and fed into a process where the material is manipulated, possibly combined with other materials, and formed into products.

When feeding a roll of material into a process, typical unwind systems may include an unwind device that is configured to hold a roll of material and to unwind the material. Such systems can also include a splicing device, a festoon, and a dancer roll.

The splicing device is for splicing a first material to a second material when the roll containing the first material is exhausted and needs to be replaced by a second full roll of material.

The basic purpose of a dancer roll is to feed the material into a process under substantially constant tension. Dancer rolls are typically positioned between two sets of driving rolls. As the material passes over the dancer roll, the dancer roll moves up and down in a track, serving two functions related to stabilizing the tension in the material. First, the dancer roll provides a tensioning force to the material. Second, the dancer roll temporarily absorbs the difference in drive speeds between the first and second sets of driving rolls. Dancer rolls are described in detail in U.S. Pat. No. 6,473,669 to Rajala et al., which is incorporated herein by reference.

Festoons, which may be placed in between the unwind device and the dancer roll, are designed to accumulate and temporarily hold a limited length of the material. The accumulated material is then released or additional length is accumulated when processing of the continuous material is temporarily interrupted. Such temporary interruptions can be, for example, when splicing a first material to a second material.

Festoons can include, for instance, a row of top idler rolls spaced from a row of bottom idler rolls. The top idler rolls are connected to a carriage that allows the rolls to move towards and away from the bottom idler rolls. The material is threaded through the festoon by passing back and forth between the bottom idler rolls and the top idler rolls. In this manner, the festoon is capable of accumulating the needed amount of material. In order to release the material, the top idler rolls move towards the bottom idler rolls decreasing the amount of material held in the festoon. Likewise, in order to increase the capacity of the festoon, the top idler rolls may move away from the bottom idler rolls.

During, for instance, a splice operation, a first roll of material is decreased in speed from the process speed to a slower speed or even stopped. Once the speed of the web is lowered, a splicing device splices a second roll of material to the first roll of material. During this time, material accumulated in the festoon continues to feed material into the process without interruption. The second roll of material is then accelerated to a rate greater than the process speed in order to re-supply the festoon. Once the festoon has accumulated a sufficient amount of material, the unwind speed of the second roll of material is decreased to the process speed.

During the above splicing operation, the idler rolls contained in the festoon are accelerated and decelerated in conjunction with the rate at which the material is unwound. In the past, material tension on the idler rolls was used to decelerate and accelerate the rolls. Consequently, the rolls were made with a low mass and low inertia.

As the need for higher process speeds increases, however, the festoon capacity required to make splices or account for other interruptions becomes prohibitably high. Further, materials are being made with very low moduli of elasticity which may become damaged or break should the material be subjected to moderate increases in tension during interruptions. As such, a need currently exists for an improved system of unwinding a roll of material that reduces the amount of festoon capacity required and which minimizes tension swings in the festoon during interruptions.

SUMMARY OF THE INVENTION

The present invention is generally directed to a system and process for unwinding a roll of material. The system and process of the present invention are particularly well suited for feeding materials into a processing line during the construction of absorbent articles. For example, in one embodiment, the system of the present invention includes a first supply station for providing a cover material into a processing line, a second supply station for providing a liner material into a processing line, and an absorbent supply source for providing an absorbent material into the processing line. The processing line is configured to place the absorbent material in between the cover material and the liner material for forming absorbent articles.

In accordance with the present invention, at least one of the cover material, the liner material, or the absorbent material is provided from an unwinding apparatus that comprises an unwind device for controlling the rate at which the roll of material is unwound. For example, in one embodiment, the unwind device rotates a spindle upon which the roll of material is mounted. Alternatively, the drive mechanism may apply a tangential force to an exterior surface of the roll of material for unwinding the roll.

A tension control device is included in the system for controlling the tension of the material after the material is unwound. For instance, the tension control device may be used so that the material is fed into a process under substantially constant tension. In one embodiment, the tension control device comprises a dancer roll spaced from a pair of stationary rolls. The dancer roll applies a determined amount of force against the material and is movable towards and away from the stationary rolls. The stationary rolls may be idler rolls or may be driven rolls.

The system further includes a festoon positioned between the unwind device and the tension control device. The festoon comprises a first set of guide rolls spaced from a second set of guide rolls. The first set of guide rolls is in operative association with a carriage. The carriage is movable towards the second set of guide rolls when a determined amount of force is placed on the carriage by the material threaded through the festoon. The festoon accumulates a determined length of the material sufficient to sustain temporary stoppages by the unwind device during an unwind process.

In accordance with the present invention, the system further includes a plurality of drive devices coupled to selected guide rolls contained in the festoon. Each of the drive devices are configured to decelerate and/or accelerate a corresponding guide roll, when the drive mechanism respectively decreases or increases the rate at which the roll of material is unwound.

By controlling the deceleration and/or acceleration rate of the guide rolls in the festoon, the storage capacity of the festoon may be reduced due to the shorter time requirements needed to decelerate and/or accelerate a material being unwound during normal stoppages, such as during a splice or during process startups or shutdowns. In this regard, process speeds may be increased without having to increase the storage capacity and size of the festoon. Tension swings in the festoon are also better controlled. Further, the unwind device may more quickly decelerate and more quickly accelerate a roll of material being unwound during interruptions without generating tensions in the festoon that may have adverse impacts upon the material or the process. The system and process of the present invention, in addition to improving web tension control, may also serve to minimize registration shifting during the process of making a product. Ultimately, the system and process of the present invention allow for faster downstream process speeds without a significant increase in the size of the festoon.

In one embodiment of the present invention, the drive devices contained in the festoon are used only to decelerate the guide rolls. In this embodiment, for instance, the drive devices may comprise brake devices. When the drive device is configured to decelerate or accelerate the guide rolls, on the other hand, the drive device may be a motor, such as a servo motor or a stepper motor.

Each drive device may be controlled by a controller, such as a microprocessor. Each drive device may be in association with a speed sensor that monitors the speed of each guide roll. Each speed sensor may send information to the controller which, in turn, accelerates and/or decelerates the guide rolls according to a predetermined deceleration or acceleration curve or profile. In one embodiment, the control of all the drive devices is coordinated to work as a system but the acceleration and/or deceleration rate of each guide roll is controlled independently according to a profile that is dependent upon the position of the guide roll on the festoon.

The festoon may include from about four (4) to about ten (10) guide rolls. For example, the festoon can include an upstream guide roll, a plurality of midstream guide rolls, and a downstream guide roll. Drive devices can be placed in association with the upstream guide roll and all of the midstream guide rolls. In general, a drive device will usually not be needed on the downstream guide roll.

In addition to a system for producing absorbent articles, the present invention is also directed to a process for producing absorbent articles. The absorbent articles are produced from a material that is unwound at a determined rate using an unwind device. The unwind device may be in communication with a festoon. The festoon includes a plurality of rotatable guide rolls through which the material being unwound is threaded. The festoon accumulates a determined length of the material sufficient to sustain temporary stoppages by the unwind device during the unwind process.

At periodic intervals, the rate at which the roll of material is unwound is decreased at the unwind device causing the accumulated length of material contained in the festoon to be released in order for the rate at which the material is moving downstream of the festoon to remain substantially unchanged. During these periodic intervals, according to the present invention, certain of the guide rolls in the festoon may be actively decelerated. The guide rolls are decelerated independent of each other. Further, the guide rolls are decelerated at a rate that generally corresponds to the rate at which the material is decelerated through the festoon. In this manner, the determined length of material that is accumulated in the festoon is minimized and tension swings in the festoon during rate decreases are lessened.

The process and system of the present invention may be integrated into various process lines for forming absorbent articles, such as diapers, adult incontinence products, feminine hygiene products, and the like. During the formation of absorbent articles, many different materials may be unwound and fed into the process for forming various elements on the formed article. The unwind system of the present invention can be used to unwind any or all of the materials being fed to the process.

For instance, in one embodiment, a processing line for forming absorbent articles contains from about 1 to about 10 or greater unwind devices in conjunction with festoons made in accordance with the present invention. The unwind device and festoon configured in accordance with the present invention may be used to unwind, for instance, cover materials, liner materials, elastic components, films, and the like.

These and other features of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
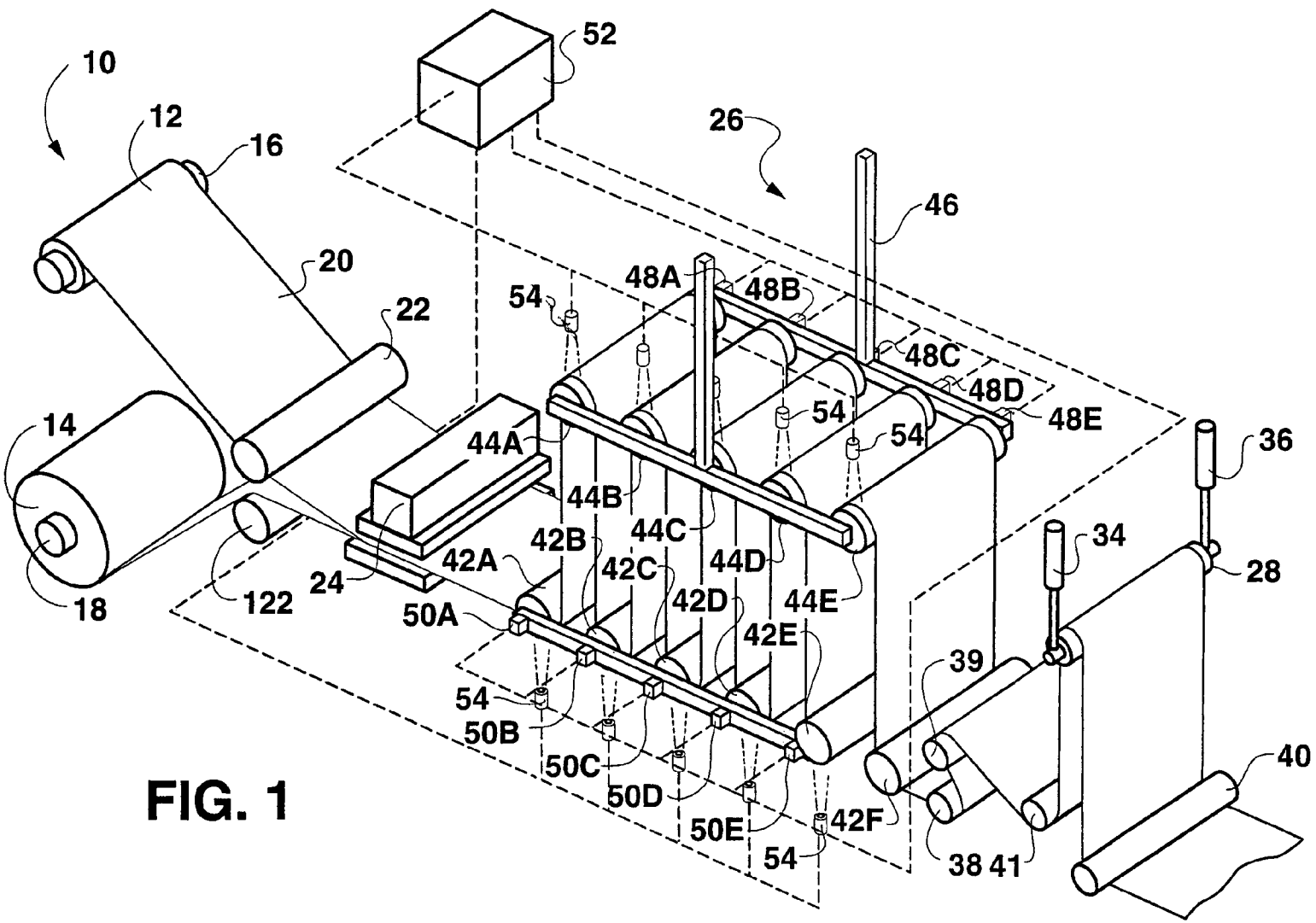
FIG. 1 is a perspective view of one embodiment of an unwind system made in accordance with the present invention.

Repeat use of reference characters in the present specification and drawings is intended to represent the same or analogous features or elements of the invention.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an unwind system designed to feed a material into a process. Any suitable material may be unwound in accordance with the present invention. For example, representative of materials that may be processed according to the present invention include nonwoven materials, elastic materials, adhesive tapes, polymeric films, mechanical fastening materials, paper webs, tissue products, and the like. These materials may be fed into a process during the formation of various different types of products. For example, the materials may be fed into a process and manipulated in order to form personal care articles, diapers, incontinence pads, feminine hygiene products, tissue products, and the like.

The system of the present invention generally includes an unwind device that is configured to unwind a roll of material. From the unwind device, the material is fed into a festoon and optionally around a dancer roll prior to undergoing downstream processing.

The festoon contained in the system is designed to hold, at steady-state operation, an accumulation of the material being fed into the process. The festoon is also designed to release the material or accumulate greater amounts of the material should there exist a speed difference between the rate at which the material is being unwound and the rate at which the material is being processed downstream.

For example, in many processes, it is desirable to feed the material into a downstream process at constant speed. The festoon may be used to ensure that the speed of the web remains unchanged even if the unwind device temporarily stops unwinding the material or, alternatively, temporarily accelerates the rate at which the material is unwound. For example, unwind devices are normally interrupted when a first roll of material is exhausted and it becomes necessary to splice a second full roll of material to a nearly unwound first roll of material.

Festoons typically contain a first row of guide rolls spaced from a second row of guide rolls. The material being unwound is threaded back and forth through the guide rolls which allows for an accumulation of the material. In one embodiment, the top guide rolls may be associated with a carriage that moves towards and away from the bottom guide rolls. When the carriage moves towards the bottom guide rolls, the amount of material stored in the festoon is reduced. When the carriage is moved away from the bottom guide rolls, on the other hand, the amount of material stored in the festoon is increased. During steady-state processing, each of the guide rolls rotate at approximately the same speed and the carriage remains in a set position. During interruptions in the rate at which the material is unwound, however, material in the festoon is either released or the amount of material stored in the festoon is increased. During these occurrences, the speed of the guide rolls vary from roll to roll. For example, should a temporary stoppage occur of the unwind device, the speed of the guide rolls may vary from zero at the upstream end to full speed at the downstream end.

In the past, the buildup of material tension through the festoon was used in order to decelerate the guide rolls and a reduction of material tension was used in order to accelerate the guide rolls. Thus, during unwind interruptions, tension swings occurred in the festoon. The minimum and maximum tension in the material is a function of the unwind deceleration and acceleration rates, guide roll inertia, festoon capacity, machine speed, festoon pressure, bearing drag, and other factors.

In general, the present invention is directed to a method and system for controlling the deceleration and acceleration rates of the guide rolls in the festoon using a plurality of drive devices associated with selected guide rolls. By actively accelerating or decelerating the guide rolls instead of relying on material or web tension, the system of the present invention offers various advantages and benefits. For example, by controlling the acceleration and/or deceleration rates of the guide rolls, the acceleration and deceleration rates of the spindles can be increased, and the festoon capacity can be minimized. Tension swings of the material in the festoon may also be reduced since web tension changes are not required to accelerate and decelerate idlers. Ultimately, the system of the present invention allows for faster processing speeds without having to increase festoon storage capacity which increases the throughput of product being produced.

Further, the system and process of the present invention are also well suited to controlling web tension during process shutdowns and process startups.

Referring to FIG. 1, one embodiment of an unwind system made in accordance with the present invention is illustrated. As shown, the system includes an unwind device generally 10 for unwinding a roll of material. In this embodiment, the unwind device 10 includes a first position for holding a first roll of material 12 and a second position for holding a second roll of material 14. The second roll of material 14 is a staging roll that is spliced to the first roll of material 12 when the first roll of material becomes exhausted. In this manner, the unwind device 10 can continuously feed material into the process.

The unwind device 10 can include any suitable drive mechanism for unwinding a roll of material either at the first position or at the second position. For example, in one embodiment, the drive mechanism can be a center unwind device that rotates a spindle 16 or 18 in order to unwind the material. Alternatively, the drive mechanism may comprise a surface unwind device that engages an exterior surface of the rolled material for unwinding the material. For example, in one embodiment, the surface unwind device may comprise a moving belt that is brought into contact with the roll of material.

In still another embodiment, a center unwind device may be used in conjunction with a surface unwind device.

As shown in FIG. 1, a material 20 is unwound from the roll 12 and fed around an idler roll 22. From idler roll 22, the material 20 passes through a splicing device 24. Splicing device 24 is for splicing the material 20 to a second roll of material 14 when the first roll of material 12 is exhausted. Thus, the splicing device 24 is activated at periodic intervals.

From the splicing device 24, the material is fed through a festoon generally 26, around a pair of driven feed rolls 38 and 39, a dancer roll 28, and an idler roll 40. As shown, the material is in an S-wrap configuration when passing over the driven feed rolls 38 and 39. In an alternative embodiment, however, it should be understood that a single driven feed roll may be used. When a single driven feed roll is used, the material 20 can be wrapped at least about 180 degrees around the roll. The speed of advance of the material 20 is controlled by the unwind device 10 in combination with the speed of the driven rolls 38 and 39. Once exiting the idler roll 40, the material 20 is manipulated and processed as desired in order to form a desired product or article.

The primary purpose of the dancer roll 28 is to attenuate tension disturbances in the web 20. Such tension disturbances might come, for example, unintended, but none the less normal vibrations emanating from equipment downstream, raw material variability, wound roll variances, and variability in bearing drag. The dancer roll 28 applies a force against the material 20 which minimizes these disturbances for feeding the material 20 into the process under substantially constant tension.

As shown in FIG. 1, the dancer roll 28 is placed in association with a pair of cylinders 34 and 36. In another embodiment, dancer roll 28 can be in association with a single cylinder 34. The cylinders 34 and 36 apply a force to the dancer roll 28 which is then applied to the web 20. The cylinders 34 and 36 may be hydraulic cylinders or pneumatic cylinders.

The dancer roll 28 is movable towards and away from the driven feed rolls 38 and 39 and the idler roll 40 which are in a fixed position. In general, to the extent the process take-away speed exceeds the speed at which the material is supplied to the dancer roll, the static forces on the dancer roll cause the dancer roll to move downwardly within its operating window. In one embodiment, as the dancer roll moves downwardly, the change in position may be sensed by, for example, a position transducer, which sends a corrective signal to the driven feed rolls 38 and 39 to increase in speed. The speed of the driven feed rolls increases enough to return the dancer roll to the midpoint of its operating window.

By corollary, if the take-away speed lags the speed at which the material is supplied to the dancer roll, the static forces on the dancer roll cause the dancer roll to move upwardly within its operating window. As the dancer roll moves upwardly, the change in position may be sensed causing the driven rolls 38 and 39 to decrease in speed, thereby returning the dancer roll to a steady-state position.

By maintaining the dancer roll 28 at the same position with respect to the idler roll 40, tension within the web of material 20 is maintained substantially constant, even if the downstream speed of the web changes. As will be described below, however, it should be understood that in an alternative embodiment, the dancer roll may be eliminated. In this embodiment, the festoon itself may be used in order to maintain the web at a relatively constant tension.

As described above, the purpose of the festoon 26 is to accumulate a determined length of the material 20. Based upon the speed differences between the material 20 at the unwind device 10, at the driven feed rolls 38 and 39, and at a downstream position, the festoon 26 is designed to either release the material contained in the festoon or to accept larger amounts of the material in the festoon. For example, should the unwind speed be less than the downstream process speed of the material, the festoon 26 releases the material. Alternatively, if the unwind speed is greater than the downstream process speed, the festoon is configured to increase in capacity. In this manner, speed changes can occur at the unwind device 10 without affecting the downstream speed of the material being fed into the process.

As shown in FIG. 1, the festoon 26 includes a row of bottom guide rolls 42A, 42B, 42C, 42D, 42E, and 42F, and a set of top guide rolls 44A, 44B, 44C, 44D, and 44E. In this embodiment, the top guide rolls 44 are all connected to a carriage 46. The carriage 46 is movable towards and away from the bottom guide rolls 42. The bottom guide rolls 42 are in a fixed position. Not shown, the carriage 46 may be placed in operative association with one or more fluid cylinders as shown with respect to the dancer roll 28. Each cylinder provides an upward force on the carriage which is offset by the web tension.

As illustrated, the material 20 is threaded back and forth between the bottom guide rolls 42 and the top guide rolls 44. In this manner, the festoon 26 accumulates a determined length of material. When the carriage 46 moves towards the bottom guide rolls 42, material contained within the festoon 26 is released to the process. Alternatively, when the carriage 46 is moved away from the bottom guide rolls 42, the capacity of the festoon 26 increases and a greater length of material is accumulated in the festoon.

During steady-state operation, the festoon 26 may operate similar to the dancer roll 28. In particular, if the festoon carriage 46 moves down due to web tension, the unwind device may be configured to automatically increase the speed at which the material is unwound. Similarly, if the carriage 46 moves up due to web tension, the unwind device may be configured to automatically decrease the speed at which the material is unwound in order to maintain the carriage in a predetermined position. In this manner, in some embodiments, the dancer roll 28 may be eliminated from the system.

In the embodiment shown, the festoon 26 includes eleven (11) guide rolls. It should be understood, however, that more or less guide rolls may be contained in the festoon. For example, in many embodiments, the festoon can contain from about two (2) to about twenty (20) rolls, and particularly from about four (4) rolls to about ten (10) rolls.

In accordance with the present invention, at least certain of the guide rolls contained in the festoon 26 are placed in association with a drive device. For example, as shown in FIG. 1, guide rolls 44A through 44E are in communication with corresponding drive devices 48A through 48E. Likewise, guide rolls 42A through 42E are in communication with corresponding drive devices 50A through 50E. The drive devices 48 and 50, in accordance with the present invention, are for individually controlling the deceleration and/or the acceleration rates of each of the guide rolls. In this embodiment, only guide roll 42F is not associated with a drive device. In most applications, guide roll 42F, the downstream guide roll, rotates at a substantially constant speed making the use of a drive device unnecessary as will be described in more detail below. In some embodiments, guide roll 42F is not even included, but instead a driven feed roll is located in its place.

The drive devices 48 and 50 accelerate and/or decelerate each corresponding guide roll in response to rate fluctuations occurring during splice sequences, during other temporary interruptions of the unwind process or during process shutdowns or startups. In this manner, tension swings through the festoon 26 are minimized. The festoon capacity required at a given line speed is also minimized. Further, by including the drive devices 48 and 50, the unwind device 10 can decelerate and/or accelerate at faster rates without creating material tensions in the festoon that normally would adversely impact upon the material.

As shown in FIG. 1, each drive device 48 and 50 is in communication with a controller 52. Controller 52 is configured to control each drive device for accelerating and/or decelerating the guide rolls as desired. The controller can be, for instance, any suitable programmable device such as a microprocessor. Further, the controller 52 can be a single programmable device or a plurality of programmable devices each connected to certain of the drive devices.

Optionally, the system further includes a plurality of speed sensors 54. In particular, a speed sensor is positioned at each guide roll where a drive device is located. The speed sensor is for sensing the rotational speed of a corresponding guide roll. Further, each speed sensor 54 is in communication with the controller 52. In this manner, the controller can receive information regarding the speed of each guide roll from the speed sensors 54 and, based upon the received information, can control each drive device 50 for decelerating and/or accelerating the guide rolls according to a predetermined profile or curve.

In general, any suitable speed sensor may be used according to the present invention. The speed sensor can be, for instance, a laser speed sensor, a contact tachometer, a non-contact tachometer, an encoder, and the like.

The drive devices 48 and 50, on the other hand, may be any suitable device that is capable of either accelerating or decelerating a guide roll. For example, when the drive devices are configured only to decelerate the guide rolls, the drive devices can comprise brake devices. Suitable brake devices include any friction brakes or mechanical brakes. Other brake devices may include piezoelectric devices.

When it is desirable to not only decelerate the guide rolls but also to accelerate the guide rolls, the drive device may comprise a motor. Suitable motors that may be used include DC stepper motors or servo motors. Such motors in combination with a drive control system are commercially available from, for instance, Animatics Corporation and the Parker Hannifan Corporation.

According to the present invention, during the release or accumulation of material in the festoon 26, the guide rolls in the festoon undergo a change in rotational speed. Further, in most applications, each guide roll is either accelerated or decelerated depending upon the circumstances independent of the other guide rolls. In the past, the acceleration or deceleration of the guide rolls was controlled by the tension of the material around the rolls. According to the present invention, however, the drive devices 48 and 50 are used to accelerate and decelerate the guide rolls independent of the other guide rolls. In this manner, the festoon may react much more quickly to changes or fluctuations in the difference between the speed of the material entering the festoon and the speed of the material exiting the festoon.

In one embodiment, the controller 52 can be preprogrammed to accelerate and/or decelerate each guide roll according to a particular profile. The profile may be created after sufficient testing of the festoon or based on models to rate changes occurring either upstream or downstream of the festoon. These profiles can then be implemented through the use of information received from the speed sensors 54.

Alternatively, the system may also operate without the use of the speed sensors. For example, in an alternative embodiment, drive devices may be used that have a particular torque profile or open loop speed control that is followed during the acceleration and/or deceleration of the guide rolls.

In FIG. 1, the drive devices 48 and 50 are shown in association with ten (10) of the eleven (11) guide rolls contained in the festoon 26. It should be understood, however, that in other embodiments a lesser number of drive devices may be desired. For example, when speed fluctuations of the material occur at the unwind device 10, most of the rate change within the festoon occurs at the upstream guide rolls. Thus, in one embodiment, only drive devices may be needed or desired at the upstream end of the festoon. In other embodiments, drive devices may only be installed at the fixed end of the carriage, such as in association with the guide rolls 42 as shown in FIG. 1. In still other embodiments, the drive devices may be placed in any particular pattern in conjunction with any guide roll as may be desired.

Figure 2A:
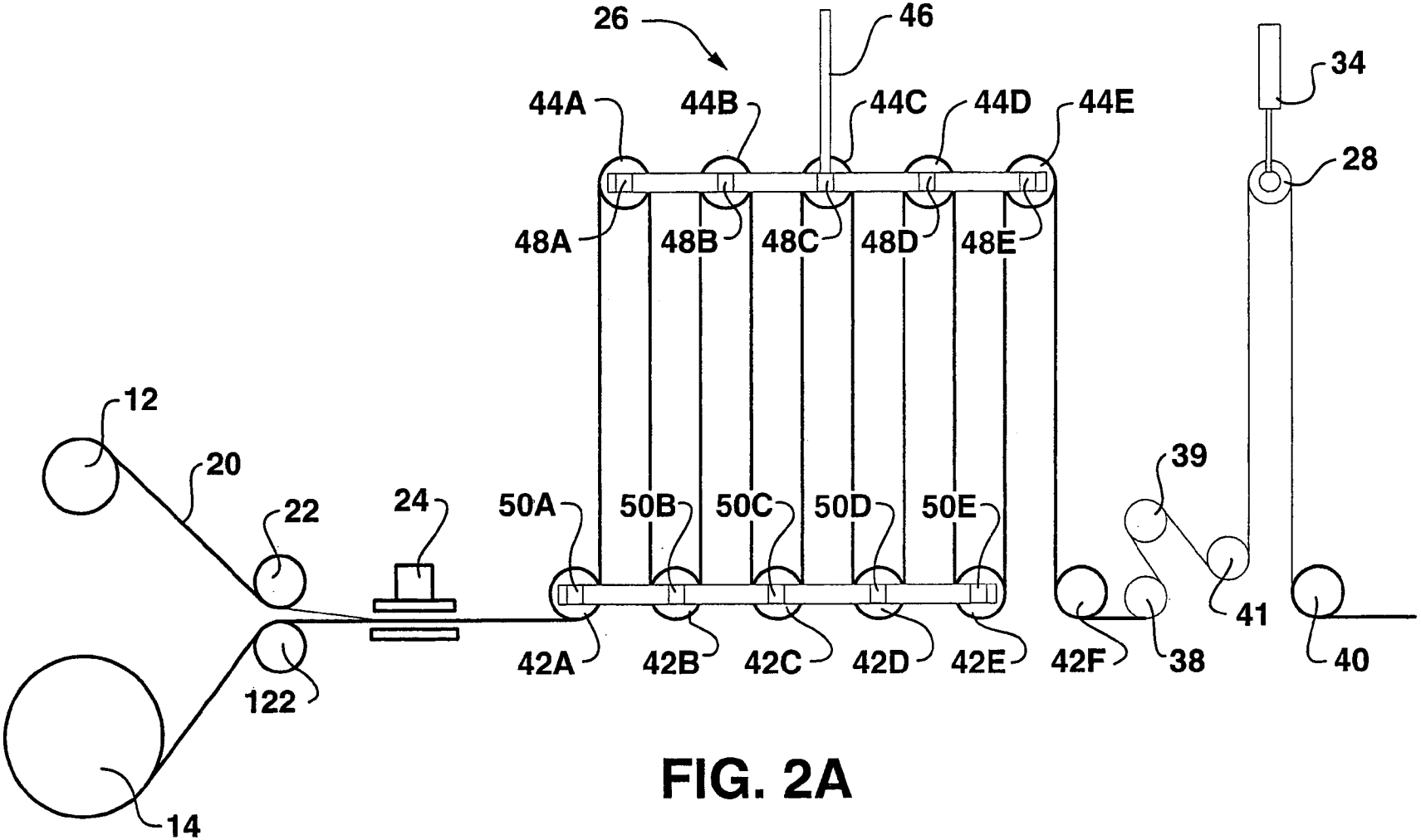
FIGS. 2A, 2B and 2C are side views of another embodiment of an unwind system made in accordance with the present invention.

In order to better explain the present invention, a splice sequence will now be described with respect to FIGS. 2A, 2B and 2C. Like reference numerals have been included in the figures in order to represent similar elements or features.

During a splice sequence, a first roll of material is spliced to a second roll of material so that the second roll of material can be fed through the process. During a splice sequence, it is desirable that the downstream speed of the material remain unchanged. Referring to FIG. 2A, the system of the present invention is shown in steady-state operation. During steady-state operation, in many applications, the drive devices are inactive. As illustrated, a first roll of material 12 is being unwound and fed into the festoon 26 prior to entering a downstream process. A staging roll 14 is also shown that is intended to replace the first roll of material 12 when the first roll of material is exhausted. The festoon has accumulated material to be fed into the process during the splice sequence.

When it is time to splice the second roll 14 to the first roll 12, the unwind speed of the material 20 is decelerated or stopped. A splicing device 24 then splices a second material 120 to the first material 20.

Figure 2B:
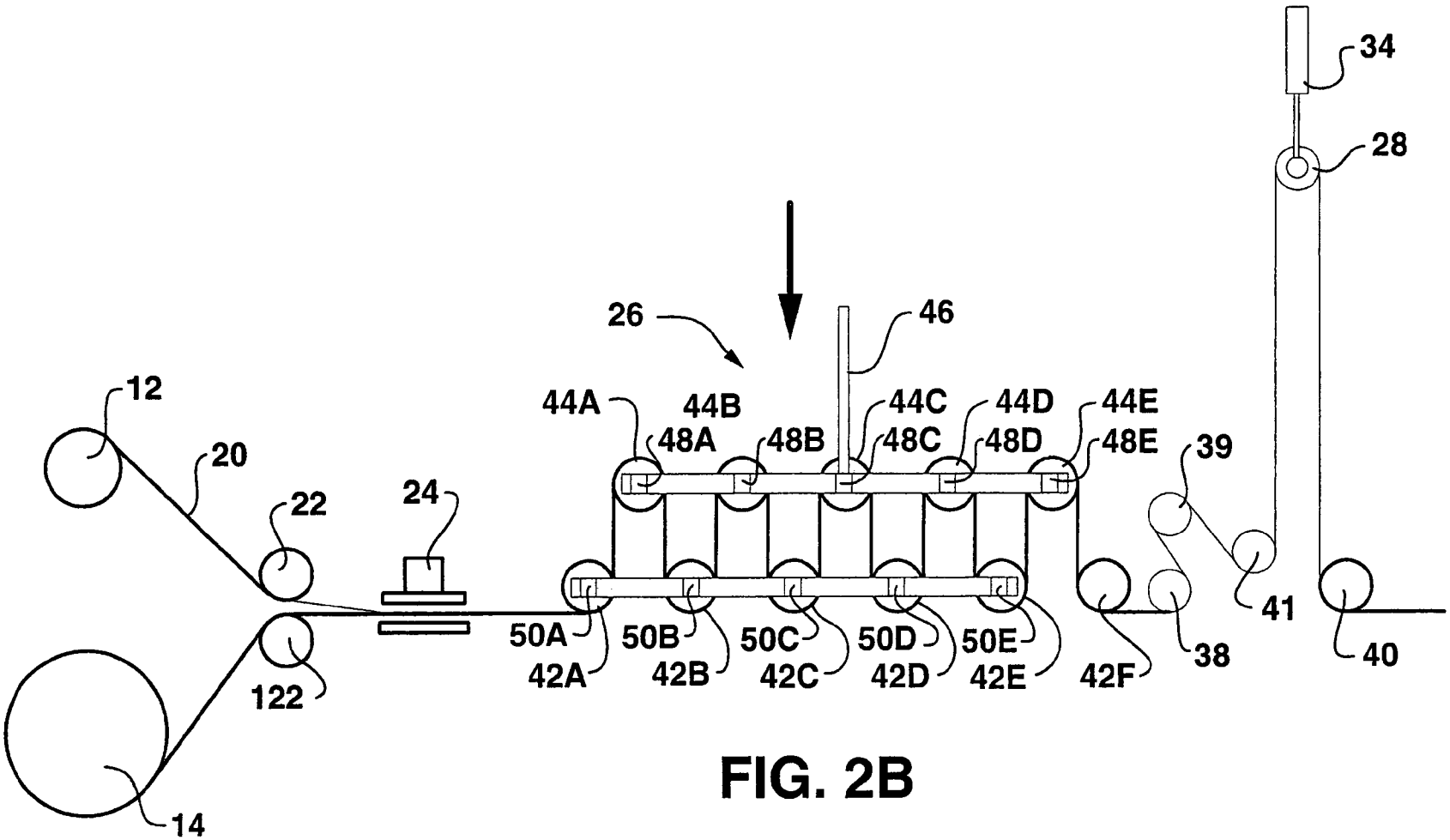

During the interruption in the winding process, the carriage 46 of the festoon 26 moves towards the bottom set of guide rolls 42 releasing material that was stored in the festoon as shown in FIG. 2B.

During the deceleration of the material 20, certain guide rolls in the festoon 26 also decelerate. For instance, if the speed of material 20 was to stop, the guide rolls within the festoon would vary in speed from zero at guide roll 42A to the downstream speed of the material at the guide roll 42F. In the past, as the material 20 decelerated at splicing device 24, tension built-up in material 20 in order to overcome the inertia of the guide rolls and slow them down. The maximum deceleration rate was a function of how much tension material 20 could tolerate. In the present invention, motors or brakes can be used to decelerate or help decelerate the guide rolls so that the tension increase in material 20 is minimized.

During the sequence, according to the present invention, the drive devices 48 and 50 may be activated by the controller causing the corresponding guide rolls to decelerate. Each guide roll may be controlled independently of the other guide rolls. In one embodiment, for instance, each guide roll may be decelerated according to a deceleration profile or curve.

Figure 2C:
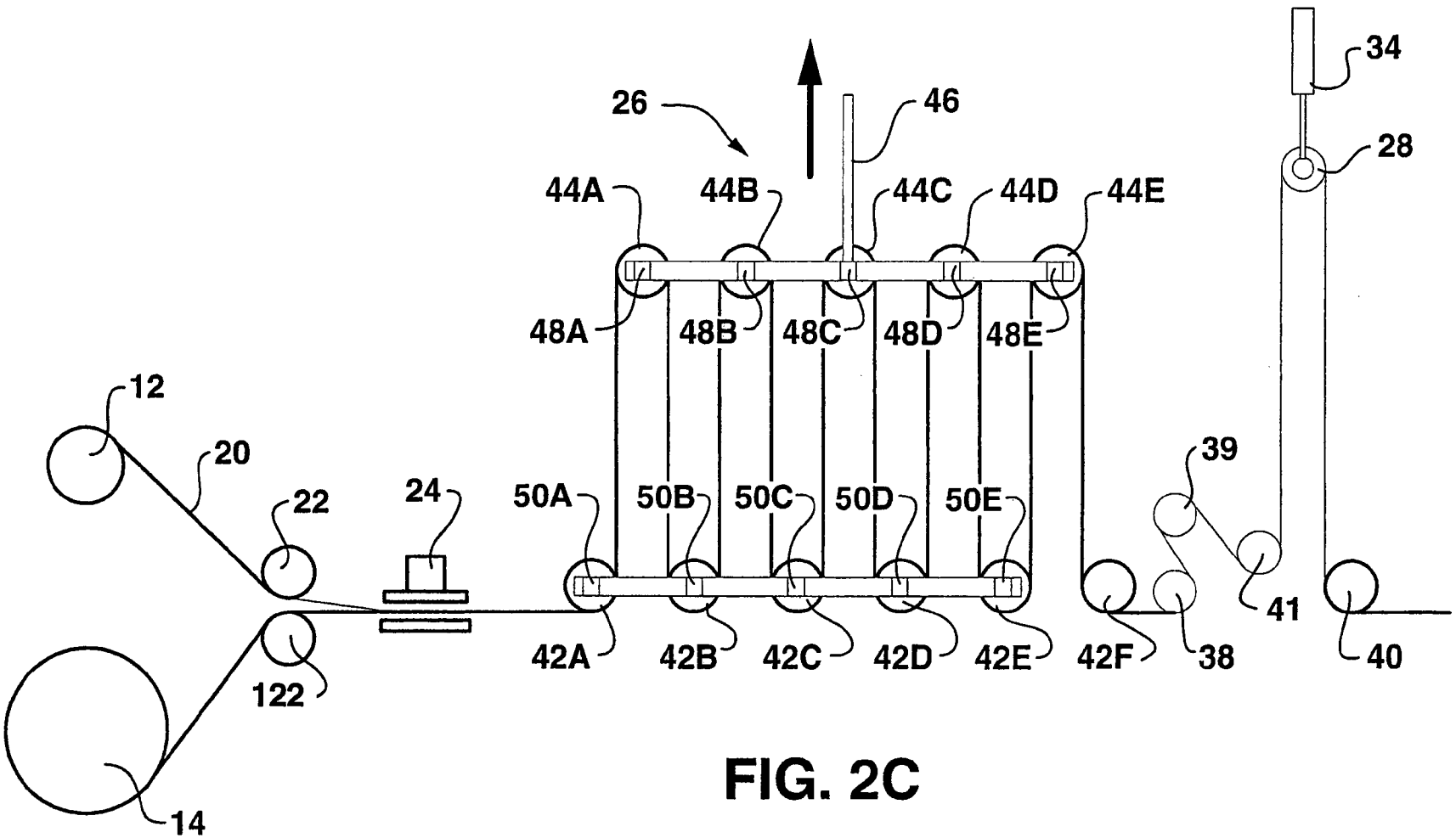

Referring to FIG. 2C, after a splice has occurred, the unwind device unwinds the second roll of material 14 into the process. At this point in the splice sequence, the carriage 46 continues to collapse until the spindle and guide rolls are accelerated back to line speed. The spindle speed or unwind speed of the material is then adjusted in order to bring the festoon carriage back to the run position. For instance, the material 120 may be fed into the festoon at a speed that is greater than the downstream speed of the material. When this occurs, the carriage 46 of the festoon 26 moves away from the bottom guide rolls 42 causing an accumulation of material to occur within the festoon.

During this sequence of events, the guide rolls 44 and 50 may be accelerated. Alternatively, the guide roll 42F may remain at the downstream process speed. In one aspect, each upstream guide roll may be accelerated to a slightly greater extent than each downstream guide roll.

During acceleration of the material 120, according to the present invention, the drive devices 48 and 50 may be activated by a controller causing the corresponding guide rolls to accelerate. As before, each guide roll is accelerated at a rate that may be independent of the remaining guide rolls. For most applications, the guide rolls may be accelerated so as to minimize the tension drop required to accelerate the guide rolls.

By controlling the acceleration and/or the deceleration rates of the guide rolls, the system of the present invention allows for the unwind device to accelerate or decelerate a roll of material at a faster rate without adverse consequences so that faster process speeds can be reached or to process lower modulus materials at current speeds.

In addition to splice sequences, the system and process of the present invention may be used during other processing conditions, such as during process startup and shutdown events. For instance, in the past, during process shutdowns, the freely rotating idler rolls in a festoon coasted to a stop. The coasting was a result of the material feed rate slowing at driven points in the process and the friction of the idler rolls. With low tension materials, however, the coasting due to the inertia of the idler rolls can cause material tensions to be at a higher or lower value than desired and can cause registration shifts. The process and system of the present invention, however, may be used to control the deceleration of the guide rolls in the festoon to avoid the inertia and coasting effects on the material in the festoon.

During process startups, on the other hand, in conventional systems, the freely rotating idler rolls in a festoon must ramp up to speed. This ramping up is induced by the tension of the web as it is accelerated by the driven points in the process. The tension of the material in the festoon must overcome the inertia of the rotating idler rolls in the festoon which can cause the tension of the material to be at a higher value than desired and can cause registration shifts. The process and system of the present invention, however, may be used to control the acceleration of the guide rolls in the festoon and reduce tension buildup in the material. Through the present invention, much weaker materials may be processed at production speeds without fear of breakage or other damage.

Figure 3:
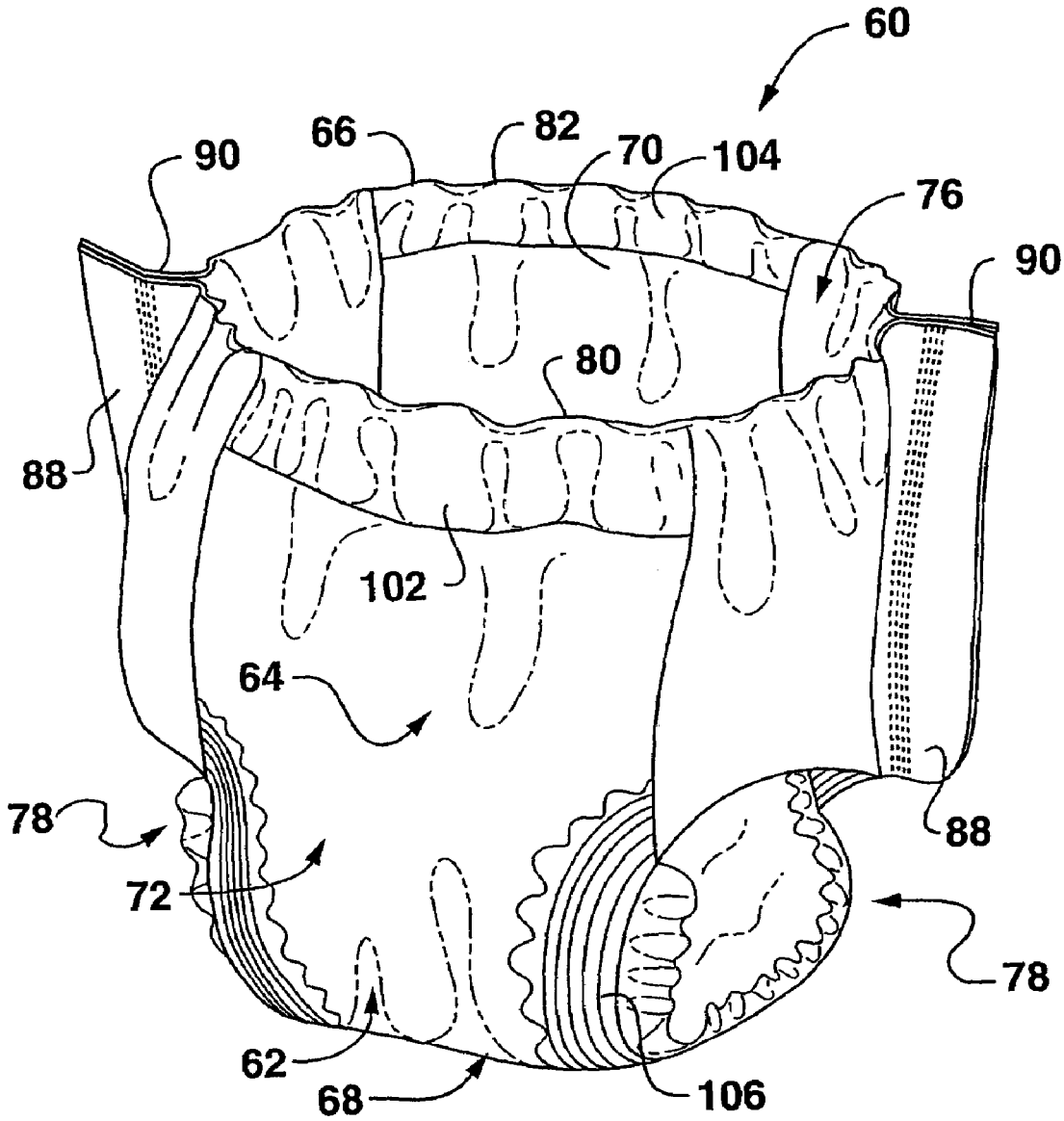
FIG. 3 is a perspective view of one embodiment of an absorbent article that may be made using the system of the present invention.

As stated above, the system of the present invention may be used to unwind various materials including nonwovens, wovens, elastic materials, polymeric films, adhesive tapes, mechanical fastening materials, paper webs, and the like. In one embodiment, the system of the present invention may be used to unwind materials during the formation of an absorbent article, such as diapers, training pants, incontinence articles and pads, feminine hygiene products, and the like. For example, referring to FIG. 3, a pant-like absorbent article generally 60 is illustrated. The article 60 includes a chassis 62 defining a front region 64, a back region 66, and a crotch region 68 interconnecting the front and back regions. The chassis 62 includes a bodyside liner 70 which is configured to contact the wearer, and an outer cover 72 opposite the bodyside liner which is configured to contact the wearer's clothing. An absorbent assembly 74 (see FIG. 6) is positioned or located between the outer cover 72 and the bodyside liner 70.

Figure 4:
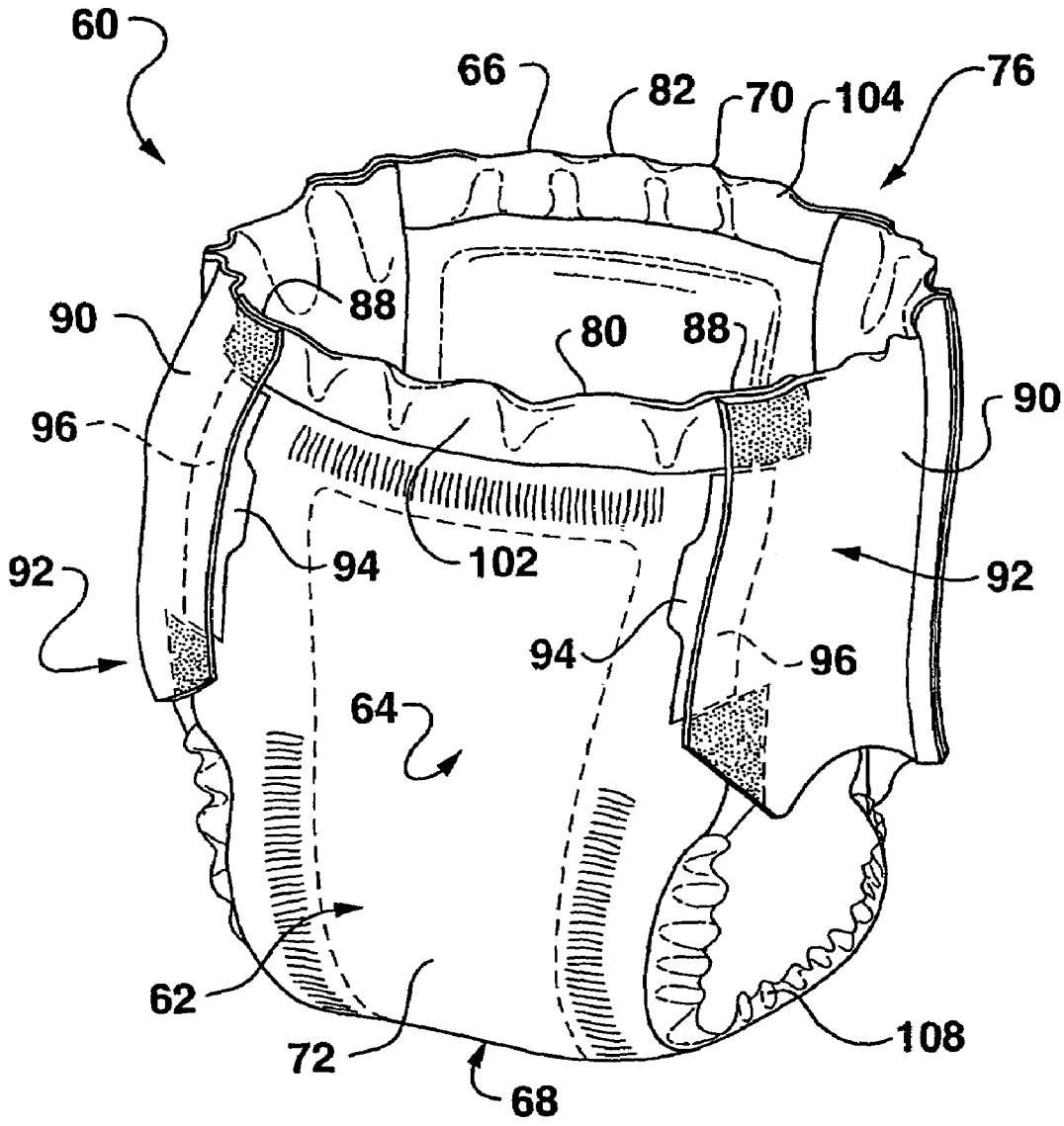
FIG. 4 is a perspective view of another embodiment of an absorbent article that may be made using the system of the present invention.

FIG. 4 illustrates an alternative embodiment of an absorbent article 60 similar to the absorbent article illustrated in FIG. 1. Like reference numerals have been used to indicate similar elements. As shown, the absorbent article 60 shown in FIG. 4, different than the embodiment shown in FIG. 3, includes refastenable sides. The absorbent article 60 shown in FIG. 3, on the other hand, has permanently bonded sides. Both embodiments of an absorbent article define a 3-dimensional pant configuration having a waist opening 76 and a pair of leg openings 78. The front region 64 includes the portion of the article 60 which, when worn, is positioned on the front of the wearer while the back region 66 includes the portion of the article which, when worn, is positioned on the back of the wearer. The crotch region 68 of the absorbent article 60 includes the portion of the article which, when worn, is positioned between the legs of the wearer and covers the lower torso of the wearer.

Figure 5:
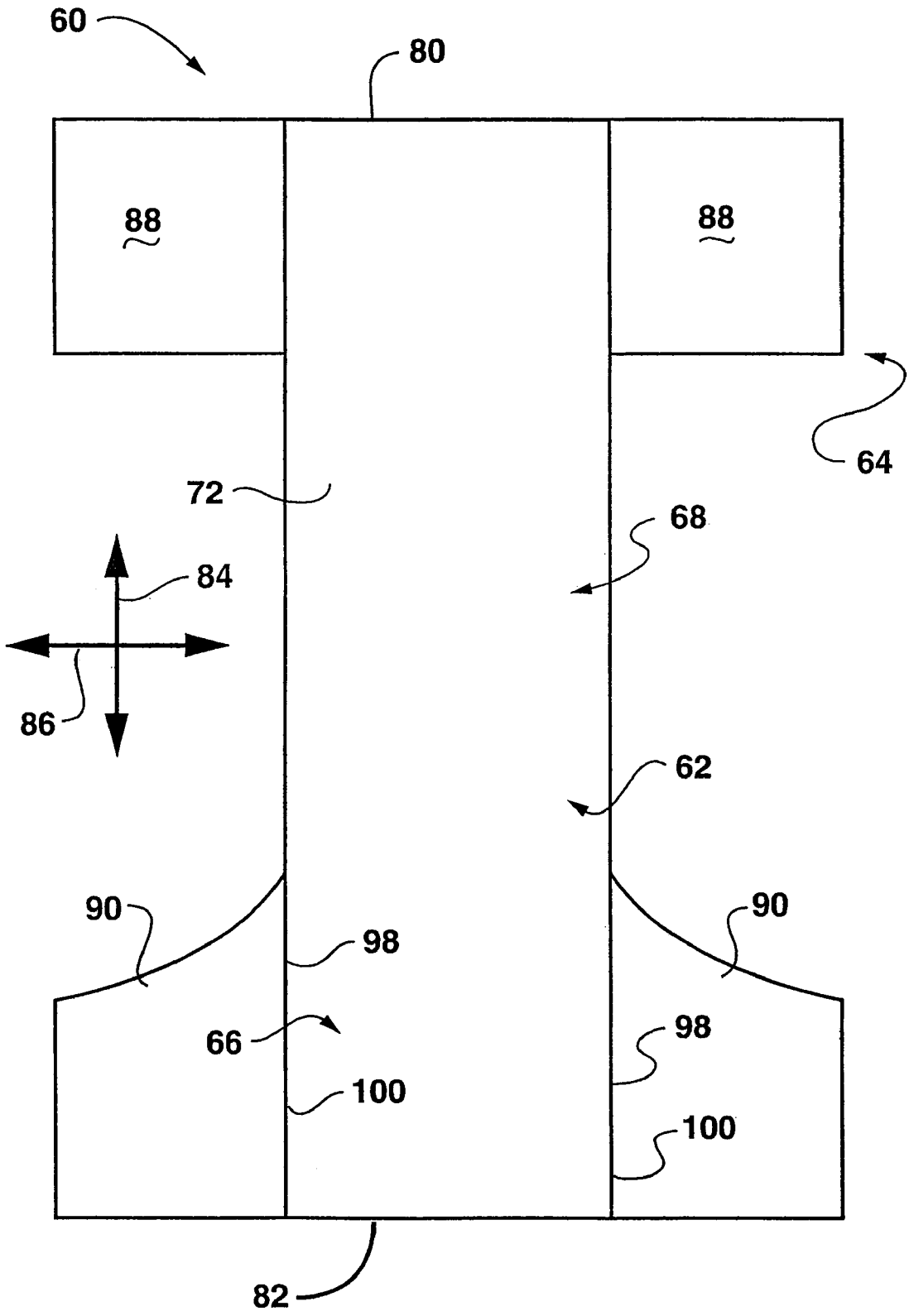
FIG. 5 is a plan view of an absorbent article that may be made using the system of the present invention.
Figure 6:
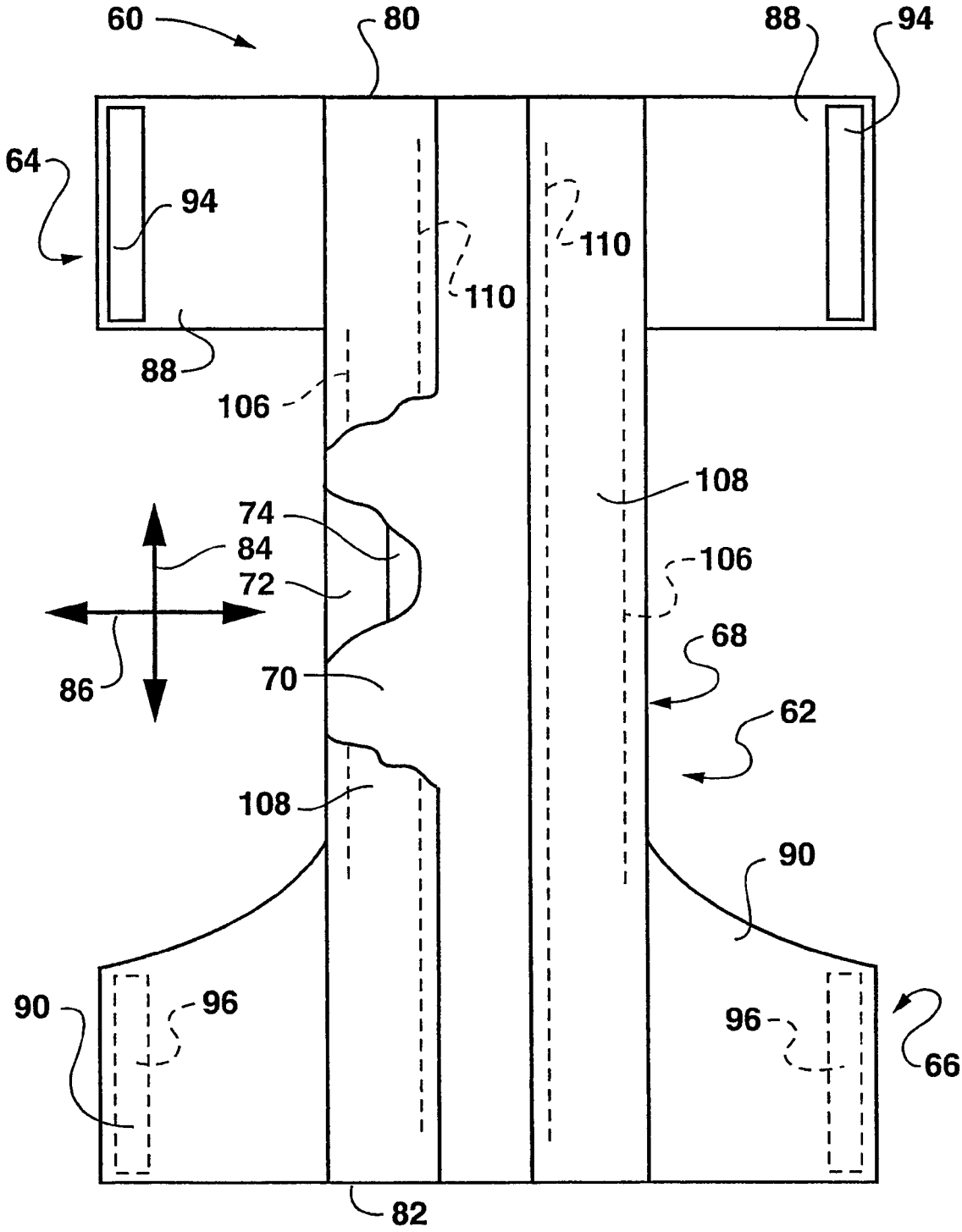
FIG. 6 is a plan view of another embodiment of an absorbent article that may be made using the system of the present invention.

As shown in further detail in FIGS. 5 and 6, the chassis 62 also defines a pair of longitudinally opposed waist edges which are designated front waist edge 80 and back waist edge 82. The front region 64 is contiguous with the front waist edge 80, and the back region 66 is contiguous with the back waist edge 82. The waist edges 80, 82 are configured to encircle the waist of the wearer when worn and define the waist opening 76. For reference, arrows 84 and 86 depicting the orientation of the longitudinal axis and the transverse axis, respectively, of the absorbent article 60 are illustrated in FIGS. 5 and 6.

The illustrated absorbent chassis 62 includes a pair of transversely opposed front side panels 88, and a pair of transversely opposed back side panels 90. The side panels 88, 90 may be integrally formed with the outer cover 72 and/or the bodyside liner 70 and/or containment flaps of the absorbent, if present, or may include two or more separate elements.

The side panels 88 and 90 desirably include an elastic material capable of stretching in a direction generally parallel to the transverse axis 86 of the absorbent article 60. Suitable elastic materials, as well as processes of incorporating side panels into a training pant, are known to those skilled in the art, and are described, for example, in U.S. Pat. No. 4,940,464 issued Jul. 10, 1990 to Van Gompel et al., which is incorporated herein by reference.

As mentioned, the absorbent article 60 according to the present invention may be refastenable, thereby including a fastening system 92 for securing the training pant above the waist of the wearer (see FIG. 4). The illustrated fastening system 92 may include fastening components 94 that are adapted to refastenably connect to mating fastening components 96. In one embodiment, one surface of each of the fastening components 94 and 96 includes a plurality of engaging elements that project from that surface. The engaging elements of these fastening components 94 are adapted to repeatedly engage and disengage the engaging elements of the mating fastening components 96.

In one particular embodiment, the fastening components 94 each include hook type fasteners and the mating fastening components 96 each include complimentary loop type fasteners. In another particular embodiment, the fastening components 94 each include loop type fasteners and the mating fastening components 96 each include complimentary hook type fasteners.

As noted previously, the illustrated absorbent article 60 has front and back side panels 88 and 90 disposed on each side of the absorbent chassis 62. These transversely opposed front side panels 88 and transversely opposed back side panels 90 can be permanently bonded to the composite structure comprising the absorbent chassis 62 in the respective front and back regions 64 and 66. Additionally, the side panels 88 and 90 can be permanently bonded to one another using suitable bonding means, such as adhesive bonds or ultrasonic bonds, to provide a non-fastenable absorbent article 60. Alternatively, the side panels 88 and 90 can be releaseably attached to one another by a fastening system 92 as described above. More particularly, as shown best in FIGS. 4 and 5, the front side panels 88 can be permanently bonded to and extend transversely beyond the linear side edges 98 of the composite structure in the front region 64 along attachment lines 100, and the back side panels 90 can be permanently bonded to and extend transversely beyond the linear side edges 98 of the composite structure in the back region 66 along attachment lines 100. The side panels 88 and 90 may be attached using attachment means known to those skilled in the art such as adhesive, thermal or ultrasonic bonding. The side panels 88 and 90 can also be formed as a portion of a component of the composite structure, such as the outer cover 72, containment flaps, if present, or the bodyside liner 70.

Each of the side panels 88 and 90 can include one or more individual, distinct pieces of material. In particular embodiments, for example, each side panel 88 and 90 can include first and second side panel portions that are joined at a seam, with at least one of the portions including an elastomeric material. Still alternatively, each individual side panel 88 and 90 can include a single piece of material which is folded over upon itself along an intermediate fold line (not shown). Desirably, the side panels 88 and 90 include an elastic material capable of stretching in a direction generally parallel to the transverse axis 86 of the absorbent article 60.

To enhance containment and/or absorption of body exudates, the absorbent article 60 may include a front waist elastic member 102, a rear waist elastic member 104, and leg elastic members 106, as are all known to those skilled in the art (see FIG. 6). The waist elastic members 102 and 104 can be operatively joined to the outer cover 72 and/or the bodyside liner 70 along the opposite waist edges 80 and 82, and can extend over part or all of the waist edges. The leg elastic members 106 are desirably operatively joined to the outer cover 72 and/or bodyside liner 70 along opposite side edges of the chassis 62 and positioned in the crotch region 68 of the absorbent article 60.

The waist elastic members 102, 104 and the leg elastic members 106 can be formed of any suitable elastic material. As is well known to those skilled in the art, suitable elastic materials include sheets, strands or ribbons of natural rubber, synthetic rubber, or thermoplastic elastomeric polymers. The elastic materials can be stretched and attached to a substrate, attached to a gathered substrate, or attached to a substrate and then elasticized or shrunk, for example with the application of heat; such that elastic constrictive forces are imparted to the substrate. In one particular embodiment, for example, the leg elastic members 106 include a plurality of dry-spun coalesced multifilament spandex elastomeric threads sold under the trade name LYCRA and available from E.I. DuPont de Nemours and Co., Wilmington, Del.

To enhance containment and/or absorption of any body exudates discharged from the wearer, the chassis 62 may include a pair of containment flaps 108 which are configured to provide a barrier to the transverse flow of body exudates. A flap elastic member 110 (see FIG. 6) may be operatively joined with each containment flap 108 in any suitable manner as is well known in the art. The elasticized containment flaps 108 define an unattached edge which assumes an upright, generally perpendicular configuration in at least the crotch region 68 of the absorbent article 60 to form a seal against the wearer's body. The containment flaps 108 can be located along the transversely opposed side edges of the chassis 62, and can extend longitudinally along the entire length of the chassis or may only extend partially along the length of the chassis. Suitable constructions and arrangements for the containment flaps 108 are generally well known to those skilled in the art.

The absorbent articles 60 as shown in FIGS. 3-6 can be made from various materials. The absorbent assembly 74, for instance, can be any structure which is generally compressible, conformable, and capable of absorbing and retaining liquids and certain body wastes. The absorbent assembly 74 can be manufactured in a wide variety of sizes and shapes, and from a wide variety of liquid absorbent materials commonly used in the art. For example, the absorbent assembly 74 can suitably include a matrix of hydrophilic fibers, such as a web of cellulosic fluff, mixed with a high-absorbency material commonly known as superabsorbent materials. In a particular embodiment, the absorbent assembly 74 includes a matrix of cellulosic fluff, such as wood pulp fluff, and superabsorbent hydrogel-forming particles. The wood pulp fluff can be exchanged with synthetic, polymeric, meltblown fibers or with a combination of meltblown fibers and natural fibers. The superabsorbent particles can be substantially homogeneously mixed with the hydrophilic fibers or can be non-uniformly mixed. The fluff and superabsorbent particles can also be selectively placed into desired zones of the absorbent assembly to better contain and absorb body exudates. The absorbent assembly 74 can have a variable thickness, with greater thickness in "target" areas, such as in a central portion of the crotch region.

Suitable superabsorbent materials can be selected from natural, synthetic, and modified natural polymers and materials. The superabsorbent materials can be inorganic materials, such as silica gels, or organic compounds, including natural materials such as agar, pectin, guar gum, and the like, as well as synthetic materials, such as synthetic hydrogel polymers.

The absorbent assembly 74 may be formed into a web structure by employing various conventional methods and techniques. For example, the absorbent assembly may be formed with a dry-forming technique, an airlaid technique, a carding technique, a meltblown or spunbond technique, a wet-forming technique, a foam-forming technique, or the like. In one embodiment, the absorbent assembly may contain a coform material. The term "coform material" generally refers to composite materials comprising a mixture or stabilized matrix of thermoplastic fibers and one or more non-thermoplastic materials. Such other materials may include, but are not limited to, fibrous organic materials such as woody or non-woody pulp such as cotton, rayon, recycled paper, pulp fluff and superabsorbent particles or fibers, inorganic absorbent materials, treated polymeric staple fibers and the like. The coform material may be formed in a meltspun process, such as in a meltblown process.

The outer cover 72 may be made from a material that is substantially liquid and permeable, and can be elastic, stretchable or nonstretchable. The outer cover 72 can be a single layer of liquid and permeable material, or may include a multi-layered laminate structure in which at least one of the layers is liquid and permeable. For instance, the outer cover 72 can include a liquid permeable outer layer and a liquid and permeable inner layer that are suitably joined together by a laminate adhesive.

For example, in one embodiment, the liquid permeable outer layer may be a spunbond polypropylene nonwoven web. The spunbond web may have, for instance, a basis weight of from about 15 gsm to about 25 gsm.

The inner layer, on the other hand, can be both liquid and vapor impermeable, or can be liquid impermeable and vapor permeable. The inner layer is desirably manufactured from a thin plastic film, although other flexible liquid impermeable materials may also be used. The inner layer prevents waste material from wetting articles such as bedsheets and clothing, as well as the wearer and caregiver. A suitable liquid impermeable film may be a polyethylene film having a thickness of about 0.2 mm.

A suitable breathable material that may be used as the inner layer is a microporous polymer film or a nonwoven fabric that has been coated or otherwise treated to impart a desired level of liquid impermeability. Other "non-breathable" elastic films that may be used as the inner layer include films made from block copolymers, such as styrene-ethylene-butylene-styrene or styrene-isoprene-styrene block copolymers.

Certain non-breathable elastic films may also be used to make the outer cover 72. Examples of suitable non-breathable films can be made of styrene-ethylene-butylene-styrene or styrene-isoprene-styrene block copolymers, KRATON polymers from KRATON Polymers LLC of Belpre, Ohio, metallocene catalyzed elastomers or plastomers, and the like. Other material suitable for making the outer cover 72 include monolithic breathable films, such as those made of polyether amide based polymers, for example PEBAX, and ether/ester polyurethane thermoplastic elastomers.

Of particular advantage, the unwind system of the present invention is particularly well suited to handling outer cover materials, such as those described above, that have a low modulus of elasticity.

As described above, the absorbent assembly is positioned in between the outer cover and a liquid permeable bodyside liner 70. The bodyside liner 70 is desirably compliant, soft feeling, and non-irritating to the wearer's skin. The bodyside liner 70 can be manufactured from a wide variety of web materials, such as synthetic fibers, natural fibers, a combination of natural and synthetic fibers, porous foams, reticulated foams, appertured plastic films, or the like. Various woven and nonwoven fabrics can be used for the bodyside liner 70. For example, the bodyside liner can be made from a meltblown or spunbonded web of polyolefin fibers. The bodyside liner can also be a bonded-carded web composed of natural and/or synthetic fibers.

A suitable liquid permeable bodyside liner 70 is a nonwoven bicomponent web having a basis weight of about 27 gsm. The nonwoven bicomponent can be a spunbond bicomponent web, or a bonded carded bicomponent web. Suitable bicomponent staple fibers include a polyethylene/polypropylene bicomponent fiber. In this particular embodiment, the polypropylene forms the core and the polyethylene forms the sheath of the fiber. Other fiber orientations, however, are possible.

The bodyside liner 70, similar to the outer cover 72, may also be made from a material that has a low modulus of elasticity. Such materials, although difficult to handle in some conventional unwind systems, are well suited for use in the system and process of the present invention.

Figure 7:
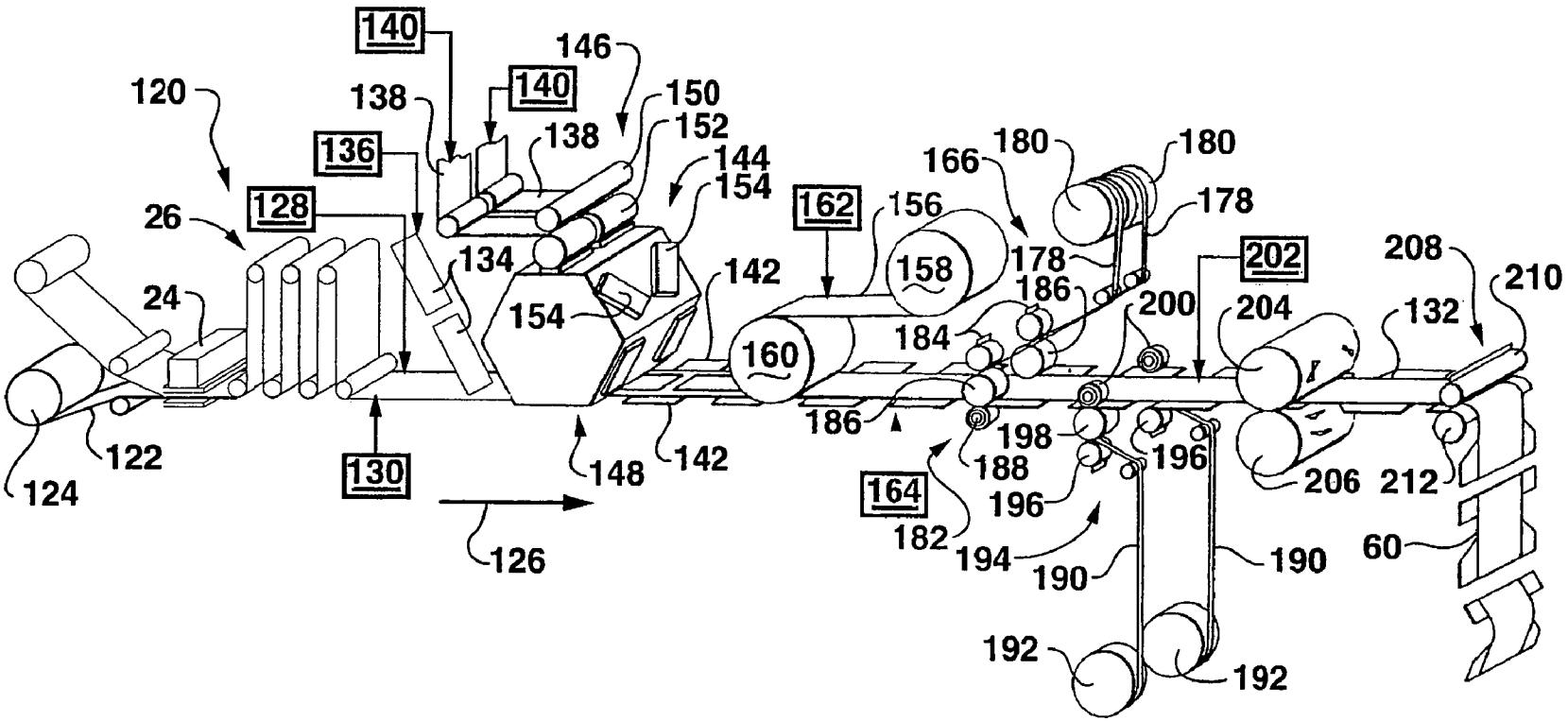
FIG. 7 is a perspective view of one embodiment of a process for forming an absorbent article incorporating an unwind device and festoon made in accordance with the present invention.

Referring now to FIG. 7, an exemplary embodiment of an assembly section 120 for making a continuous stream of partially assembled, discrete pants or garments 60 is illustrated. The specific equipment and processes used in the assembly section 120 can vary greatly depending on the specific type of garment being manufactured. The particular process and apparatus described in relation to FIG. 7 is specifically adapted to manufacture absorbent articles 60 pull-on style of the type illustrated in FIGS. 4 through 6.

The various components of the garment 60 can be connected together by any means known to those skilled in the art such as, for example, adhesive, thermal and/or ultrasonic bonds. Desirably, most of the components are connected using ultrasonic bonding for improved manufacturing efficiency and reduced raw material costs. Certain garment manufacturing equipment which is readily known and understood in the art, including frames and mounting structures, ultrasonic and adhesive bonding devices, transport conveyors, transfer rolls, guide rolls, tension rolls, and the like, have not been shown in FIG. 7.

A continuous supply of material 122 used to form the bodyside liner 70 is provided from a supply source 124. The supply source 124 can include for example a pair of spindles, a festoon assembly 26, and optionally a dancer roll (not shown) for providing bodyside liner material 122 at a desired speed and tension.

As shown in FIG. 7, the supply of material 122 is unwound from the supply source 124 and fed through a festoon 26 made in accordance with the present invention. In accordance with the present invention, the festoon 26 includes drive devices associated with selected guide rolls for increasing and/or decreasing acceleration rates of the guide rolls within the festoon.

In the embodiment shown in FIG. 7, only one festoon and unwind device configured in accordance with the present invention is shown in unwinding material 122. It should be understood, however, that the unwind system of the present invention may be placed at other locations throughout the process for unwinding other materials. The system of the present invention may be used, for instance, to unwind an outer cover material, and various other components used to form the absorbent article 60.

Various components can be disposed on and/or bonded to the bodyside liner material 122 as the material travels in a machine direction identified by arrow 126. In particular, a surge layer can be provided at an application station 128 and disposed on and/or bonded to the bodyside liner material 122. The surge layer can include either a continuous web or discrete sheets. Additionally, a containment flap module 130 can be provided downstream of the supply source 124 for attaching pre-assembled containment flaps to the bodyside liner material 122. As various components are added in the assembly section 120, a continuously moving product assemblage 132 is formed. The product assemblage 132 will be cut downstream to form the partially assembled, discrete garments 60.

A plurality of absorbent assemblies 134 can be provided from a suitable supply source 136. The supply source 136 can be any conventional mechanism for supplying the absorbent assemblies 134. Generally, a conventional supply source can include a hammermill for forming fluff fibers and, if desired, an enclosure for mixing superabsorbent material with the fluff fibers, and then depositing the fluff and superabsorbent material on a forming drum having a desired absorbent design. The individual absorbent assemblies 134 can be disposed intermittently on the continuously moving bodyside liner material 122, one for each pant. The position of the absorbent assemblies 134 can be registered with the position of the surge material, if employed. The absorbent assemblies 134 can be bonded to one or more other components using adhesives or other suitable means. Alternatively, composite absorbent materials can be fed into the converting process from rolls or compressed packages, such as festooned bales.

In FIG. 7, the absorbent assemblies 134 are shown precut when fed into the process. It should be understood, however, that in other embodiments, instead of individual absorbent assemblies 134, a continuous web of absorbent material may be fed into the process and cut into individual absorbent assemblies downstream from the supply source 136. In this embodiment, the absorbent material may be air formed as described above, or may be formed by any other suitable process, such as a coform process, a meltblown process, a spunbond process, and the like. When feeding a continuous supply of absorbent material into the process, the material may be fed through a festoon made in accordance with the present invention. The festoon may include drive devices associated with selective guide rolls for increasing and/or decreasing acceleration rates of the guide rolls within the festoon for unwinding the absorbent material during, for instance, splicing operations.

Assembly section 120 can include a device to apply side panels. For example, continuous webs of material 138 used to form the side panels 88 and 90 can be provided from suitable supply sources 140. The supply sources 140 can include one or more unwind mechanisms. In one embodiment, for instance, the webs of material 138 may be unwound using an unwind device and festoon configured in accordance with the present invention. The side panel material 138 can be cut into individual strips 142 and positioned partially on the bodyside liner material 122 using an applicator device 144. In the cross machine direction, the individual strips 142 desirably extend laterally outward from the bodyside liner material 122 and overlap the bodyside liner material to permit bonding of the strips to the bodyside liner and/or the containment flap material. Bonding may be accomplished using adhesives, as is well known in the art, or by any other bonding means. In the machine direction 126, the position of the strips 142 can be registered relative to the absorbent assemblies 134 so that the product assemblage 132 can be cut between the absorbent assemblies with each strip 142 of side panel material 138 forming both a front side panel 88 and a back side panel 90 of consecutive garments 60.

One suitable applicator device 144 is disclosed in U.S. Pat. No. 5,104,116 issued Apr. 14, 1992 and U.S. Pat. No. 5,224,405 issued Jul. 6, 1993 both to Pohjola, which are incorporated herein by reference. The applicator device 144 can include a cutting assembly 146 and a rotatable transfer roll 148. The cutting assembly 146 employs a rotatable knife roll 150 and a rotatable vacuum anvil roll 152 to cut individual strips 142 from the continuous side panel material 138. The strips 142 cut by a blade on the knife roll 150 can be maintained on the anvil roll 152 by vacuum and transferred to the transfer roll 148.

The rotatable transfer roll 148 can include a plurality of rotatable vacuum pucks 154. The vacuum pucks 154 receive the strips 142 of material 138 from the cutting assembly 146 and rotate and transfer the strips to the continuously moving bodyside liner material 122. When the strips 142 are positioned as desired relative to the bodyside liner material 122, the strips are released from the pucks 154 by extinguishing the vacuum in the pucks. The pucks 154 can continue to rotate toward the cutting assembly 146 to receive other strips.

Alternative configurations for attaching the side panel material 138 exist. For instance, the material 138 used to form the side panels can be provided in continuous form and contour cut to form leg openings 78. Still alternatively, the, side panels 88 and 90 of the pant 60 can be provided by portions of the bodyside liner 70 and/or outer cover 72. It should be noted that the side panel application processes just described are exemplary only, and that the process can vary greatly depending on the physical characteristics of the material and the nature of the process.

A continuous supply of material 156 used to form the outer cover 72 can be provided from a supply roll 158 or other suitable source. In one embodiment, the outer cover material 156 may be unwound from the supply roll 158 using the unwind system made in accordance with the present invention. As the material is unwound, the outer cover material 156 can be married with the bodyside liner material 122 such as by use of a laminator roll 160. The absorbent assemblies 134 are thereby sandwiched between the continuous materials 122 and 156. The inward portions of the strips 142 of side panel material 138 can also be disposed between the bodyside liner material 122 and the outer cover material 156. Various components such as leg elastics 106 or waist elastics 102 and 104 can be bonded to the outer cover material 156 at an application station 162 prior to uniting the bodyside liner and outer cover materials 122 and 156. Alternatively, leg elastics or waist elastics can be initially bonded to the bodyside liner material 122 or another material.

The outer cover 156 can be joined to the liner-side panel composite using any means known to those of skill in the art. Where an adhesive is used, the adhesive can be applied on or prior to laminator roll 160. Alternatively, bonding devices such as ultrasonic or thermal bonders can be employed as part of the laminator roll 160 or at a downstream location 164 to bond the bodyside liner material 122, side panel material 138 and outer cover material 156.

The assembly section 120 can include apparatus to provide/apply a fastening system to the garment 60. For example, the continuously moving product assemblage next advances to a fastener application station 166 where fastening components 94 and 96 are bonded to the strips 142 of side panel material 138. The location of the fastening components on the composite is a function in part of the configuration of the assembly section 120. The illustrated assembly section 120 is configured so that the upwardly facing surface of the product assemblage 132 will become the outer surface of the pant 60 and the downwardly facing surface will become the inner surface. Moreover, the illustrated assembly section 120 is configured to produce partially assembled garments 60 having the front waist region 64 of a leading garment connected to the back waist region 66 of a trailing garment. The process could alternatively employ any combination of different orientations. For example, the upwardly facing surface of the product assemblage could form the inner surface of finished garments. Additionally or alternatively, the back waist region 66 of a leading garment can be connected to the front waist region 64 of the trailing garment, or the garments can be arranged in a front-to-front/back-to-back relationship. Still alternatively, the assembly section 120 can be constructed as a cross-machine direction process wherein the longitudinal axis of each garment could be perpendicular to the machine direction 126 during part or all of the assembly process.

As shown in FIG. 1, continuous webs of a fastener material 178 used to form the fastening components 96 (FIGS. 4 and 6) can be provided from supply rolls 180 or other suitable sources. The fastener materials 178 can be cut into individual fasteners 96 by cutting assemblies 182 or other suitable devices. The illustrated cutting assemblies 182 include rotatable knife rolls 184, rotatable vacuum anvil rolls 186, and rotatable backing rolls 188. The continuous fastener materials 178 can be cut by blades on the knife rolls 184, maintained on the anvil rolls 186 by vacuum, and disposed on the top surfaces of the strips 142 of side panel material 138.

Similarly, continuous webs of a fastener material 190 used to form the fastening components 94, shown in FIGS. 4 and 6, can be provided from supply rolls 192 or other suitable sources. The first fastener materials 190 can be cut into individual first fasteners 94 by cutting assemblies 194 or other suitable devices.

In the embodiment shown in FIG. 7, the supply rolls 180 and 192 are shown feeding the material 178 and the material 190 into the process. In accordance with the present invention, if desired, supply rolls 180 and 192 may be supplied from an unwind device that is in communication with a festoon made in accordance with the present invention.

Alternatively, a component of the garment 60 may serve as the fastening components, in which case the fastener application station 166 or the cutting assemblies 194 may not be needed. The illustrated cutting assemblies 194 include rotatable knife rolls 196, rotatable vacuum anvil rolls 198, and rotatable backing rolls 200. The continuous fastener materials 190 can be cut by blades on the knife rolls 196, maintained on the anvil rolls 198 by vacuum, and disposed on the undersides of the strips 142 of side panel material 138.

Other arrangements can be used to attach the fastening components 94 and 96. For example, the fastening components can be applied to the side panel material 138 prior to uniting the side panel material with the bodyside liner material 122 and/or the outer cover material 156; the fastening components can be applied to the bodyside liner material 122 and/or outer cover material 156, whether separate side panels are used or not; portions of other components such as the bodyside liner and/or outer cover can form one or more of the fastening components; the separate side panels or integral side panels can themselves form one or more of the fastening components; the fastening components can be attached as pre-engaged composites; or the like.

After the fastening components are disposed on the strips 142 of side panel material 138, bonding devices 202 such as ultrasonic bonders can be employed to bond the fastening components to the strips. For example, the strips 142 can be transported between a rotary ultrasonic horn and an anvil roll, which devices are positioned on each side of the process at the cross machine direction location of the fastening components 94 and 96. Particular ultrasonic bond patterns including individual, circular bonds which are compatible with mechanical fastening materials are disclosed in U.S. Pat. No. 5,660,666 issued Aug. 26, 1997 to Dilnik et al., which is incorporated herein by reference. Efficient arrangements for attaching the fastening components with nonadhesive bonding devices are further described in U.S. Pat. No. 6,562,167, filed on May 15, 2001 by J. D. Coenen et al. and titled "Methods For Making Garments With Fastening Components", which is incorporated herein by reference. For secure attachment, it may be desirable to attach the fastening components with both adhesive and thermal bonds. Suitable attachment adhesives are available from commercial vendors such as Findley Adhesive, Inc., Wauwatosa, Wis. U.S.A.

The strips 142 of side panel material 138 can be trimmed if desired, for example to provide angled and/or curved leg end edges in the back waist region. To this end, the assembly section 120 can include a die cutting roll 204 and a backing roll 206. In the illustrated embodiment, a portion of each strip 142 is trimmed from a trailing edge in order to form the angled and/or curved leg end edges in the back waist region.

The method and apparatus to this point provides a continuous web of interconnected and partially assembled pants moving in the direction indicated by arrow 126. This continuously moving product assemblage 132 is passed through a cutter 208 which selectively cuts the web into discrete, partially assembled garments 60. Such cutters 208 are generally known to those skilled in the art and can include, for example, the combination of a cutting roll 210 and an anvil roll 212 through which the web travels. The anvil roll 212 can include a hardened steel rotating roll while the cutting roll 210 can include one or more flexible hardened steel blades clamped onto another rotating roll. The pinching force between the blade on the cutting roll 210 and the anvil roll 212 creates the cut. The cutting roll 210 can have one or more blades depending upon the desired distance between the cuts. The cutter 208 can further be configured to provide a spacing between the individual cut pieces after they are cut. Such a spacing can be provided by transferring the cut pieces away from the cutter at a higher speed than the speed at which the web is provided to the cutter.

The discrete garments 60 can then be folded and packaged as desired.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for forming an absorbent article comprising:

unwinding a roll of a first material at a determined rate for processing using an unwind device, the unwind device being in communication with a festoon, the festoon including a plurality of rotatable guide rolls through which the first material being unwound is threaded, the festoon accumulating a determined length of the first material and wherein, during steady state, at least certain of the guide rolls are not actively driven such that the guide rolls comprise idler rolls;

decreasing the rate at which the roll of the first material is unwound causing the accumulated length of material contained in the festoon to be released in order for the rate at which the first material is moving downstream of the festoon to remain substantially unchanged;

decelerating certain of the guide rolls in the festoon with a drive device when the rate at which the roll of the first material is unwound decreases at the unwind device, the guide rolls being decelerated independent of each other; and wherein the first material being unwound is fed into a process for forming absorbent articles, the first material being incorporated into the absorbent article, the absorbent article comprising a liner material, an outer cover material, and an absorbent material positioned in between the liner material and the outer cover material.

2. A process as defined in claim 1, further comprising the steps of:

increasing the rate at which the roll of the first material is unwound at the unwind device after the rate has been decreased; and accelerating certain of the guide rolls in the festoon with the drive device when the rate at which the roll of material is unwound increases, the guide rolls being accelerated independent of each other, the guide rolls being accelerated at a rate that generally corresponds to the rate at which the first material is accelerated through the festoon.

3. A process as defined in claim 1, wherein the festoon includes from about four (4) to about (10) guide rolls.

4. A process as defined in claim 1, wherein the guide rolls that are decelerated by a drive device are decelerated according to a predetermined deceleration profile.

5. A process as defined in claim 4, wherein the speed of the guide rolls being decelerated by a drive device is monitored and sent to a controller, the controller being configured to decelerate the guide rolls according to the deceleration profile based upon the monitored speed of each guide roll.

6. A process as defined in claim 1, wherein the drive device comprises a braking device.

7. A process as defined in claim 1, wherein the drive device comprises a stepper motor or a servo motor.

8. A process as defined in claim 1, wherein the festoon includes an upstream guide roll, a plurality of midstream guide rolls, and a downstream guide roll, and wherein the upstream guide roll and the midstream guide rolls are decelerated by drive devices.

9. A process as defined in claim 1, wherein the rate at which the roll of material is unwound is decreased and temporarily stopped.

10. A process as defined in claim 1, wherein the first material being unwound from the roll is spliced to a second roll of material during the decrease in rate at which the roll of material is unwound.

11. A process as defined in claim 1, wherein the festoon includes a first set of guide rolls spaced from a second set of guide rolls, the first set of guide rolls being in operative association with a carriage, the carriage being movable towards the second set of guide rolls when the rate of material exiting the festoon is greater than the rate of material entering the festoon.

12. A process as defined in claim 11, wherein the carriage moves toward and away from the second set of guide rolls due to tension of the first material in the festoon.

13. A process as defined in claim 1, wherein the roll of material is unwound at a rate of at least 100 feet per minute.

14. A process as defined in claim 1, wherein the festoon accumulates a length of material sufficient to sustain a stoppage of from about one (1) second to about five (5) seconds during the unwind process.

15. A process as defined in claim 1, wherein the absorbent article is one of diapers, child's training pants, feminine care articles, and incontinence articles.

16. A process as defined in claim 1, wherein the first material comprises the liner material, the cover material, or the absorbent material.

17. A process as defined in claim 1, wherein the first material has a basis weight of less than about 25 gsm.

18. A process for forming an absorbent article comprising:

unwinding a roll of a first material at a determined rate for processing using an unwind device, the unwind device being in communication with a festoon, the festoon including a plurality of rotatable guide rolls through which the first material being unwound is threaded, the festoon accumulating a determined length of the first material;

decreasing the rate at which the roll of the first material is unwound causing the accumulated length of material contained in the festoon to be released in order for the rate at which the first material is moving downstream of the festoon to remain substantially unchanged;

decelerating certain of the guide rolls in the festoon with a drive device when the rate at which the roll of the first material is unwound decreases at the unwind device, the guide rolls being decelerated independent of each other, the guide rolls being decelerated based upon an amount of inertia contained in the respective guide roll so as to minimize tension increases or decreases in the first material; and wherein the first material being unwound is fed into a process for forming absorbent articles, the first material being incorporated into the absorbent article, the absorbent article comprising a liner material, an outer cover material, and an absorbent material positioned in between the liner material and the outer cover material.

19. A process as defined in claim 18, further comprising the steps of:

increasing the rate at which the roll of the first material is unwound at the unwind device after the rate has been decreased; and accelerating certain of the guide rolls in the festoon with the drive device when the rate at which the roll of material is unwound increases, the guide rolls being accelerated independent of each other, the guide rolls being accelerated at a rate that generally corresponds to the rate at which the first material is accelerated through the festoon.

20. A process as defined in claim 18, wherein the festoon includes from about four (4) to about (10) guide rolls.

21. A process as defined in claim 18, wherein the guide rolls that are decelerated by a drive device are decelerated according to a predetermined deceleration profile.

22. A process as defined in claim 21, wherein the speed of the guide rolls being decelerated by a drive device is monitored and sent to a controller, the controller being configured to decelerate the guide rolls according to the deceleration profile based upon the monitored speed of each guide roll.

23. A process as defined in claim 18, wherein the drive device comprises a braking device.

24. A process as defined in claim 18, wherein the drive device comprises a stepper motor or a servo motor.

25. A process as defined in claim 18, wherein the festoon includes an upstream guide roll, a plurality of midstream guide rolls, and a downstream guide roll, and wherein the upstream guide roll and the midstream guide rolls are actively decelerated by drive devices.

26. A process as defined in claim 18, wherein the rate at which the roll of material is unwound is decreased and temporarily stopped.

27. A process as defined in claim 18, wherein the first material being unwound from the roll is spliced to a second roll of material during the decrease in rate at which the roll of material is unwound.

28. A process as defined in claim 18, wherein the festoon includes a first set of guide rolls spaced from a second set of guide rolls, the first set of guide rolls being in operative association with a carriage, the carriage being movable towards the second set of guide rolls when the rate of material exiting the festoon is greater than the rate of material entering the festoon.

29. A process as defined in claim 28, wherein the carriage moves toward and away from the second set of guide rolls due to tension of the first material in the festoon.

30. A process as defined in claim 18, wherein the roll of material is unwound at a rate of at least 100 feet per minute.

31. A process as defined in claim 18, wherein the festoon accumulates a length of material sufficient to sustain a stoppage of from about one (1) second to about five (5) seconds during the unwind process.

32. A process as defined in claim 18, wherein the absorbent article is one of diapers, child's training pants, feminine care articles, and incontinence articles.

33. A process as defined in claim 18, wherein the first material comprises the liner material, the cover material, or the absorbent material.

34. A process as defined in claim 18, wherein the first material has a basis weight of less than about 25 gsm.

* * * * *